US005860217A

United States Patent [19]

Braun

[11] Patent Number: 5,860,217

[45] Date of Patent: Jan. 19, 1999

[54] MATERIAL CIRCLE CUTTER

[76] Inventor: Elaine A. Braun, P.O. Box 211145, Auke Bay, Ak. 99821

[21] Appl. No.: 975,077

[22] Filed: Nov. 20, 1997

Related U.S. Application Data

[60] Provisional application No. 60/031,875 Nov. 24, 1996.

[51] Int. Cl.[6] ..... B26D 1/15

[52] U.S. Cl. ..... 30/300; 30/310

[58] Field of Search ..... 30/300, 310, 347; 83/745

[56] References Cited

U.S. PATENT DOCUMENTS

| | | |
|---|---|---|
| 1,423,828 | 7/1922 | Butterfield . |
| 2,066,381 | 1/1937 | Albertson . |
| 2,230,400 | 2/1941 | Cadirola . |
| 3,456,346 | 7/1969 | Snyder . |
| 3,621,574 | 11/1971 | Yanke et al. . |
| 3,934,343 | 1/1976 | Witecki . |
| 4,173,913 | 11/1979 | Nicholson . |
| 4,426,781 | 1/1984 | Kufrin . |
| 4,593,467 | 6/1986 | Safar . |
| 4,645,390 | 2/1987 | Pecha et al. . |

FOREIGN PATENT DOCUMENTS

| | | | |
|---|---|---|---|
| 119286 | 7/1927 | Germany . | |
| 495497 | 4/1930 | Germany | 30/300 |
| 2910642 | 9/1980 | Germany . | |

*Primary Examiner*—Douglas D. Watts
*Attorney, Agent, or Firm*—Richard C. Litman

[57] ABSTRACT

A circular material cutter having a disk-shaped base with a rotating top member attached thereto via a spring and shaft assembly. The top member has a handle formed on its top surface and four legs which extend downwardly from the top surface radial edge, and which have cutting wheels rotatably mounted on their bottom ends of the legs. The shaft and spring assembly extends upwardly from the radial center of the base and is held in a spring receiving portion which extends downward from the radial center of the top member. The shaft and spring assembly allows the top member to be rotated above the base, and also biases the top member away from the base when the device is not in use, to keep the cutting wheels in a retracted position. To use the device, one places the device on sheet material to be cut, pushes down on the top member, and twists it 90° using the handle, thereby causing the four cutting wheels to cut a circular piece from a sheet of material. An adjustable embodiment permitting selected circles of different radii to be cut is also described.

13 Claims, 8 Drawing Sheets

MATERIAL CIRCLE CUTTER

CROSS-REFERENCE TO RELATED APPLICATION

This application claims the benefit of U.S. Provisional patent application Ser. No. 60/031,875, filed Nov. 29, 1996.

BACKGROUND OF THE INVENTION

1. Field of the Invention

The present invention relates to a device for aiding in cutting circular pieces from sheet material, and more specifically, to a material cutter with a plurality of cutting wheels which are rotated to cut arcs approximating a circle from a sheet of material.

2. Description of Related Art

When performing home crafts such as making a quilt, it is often necessary to cut a circular piece from a sheet of fabric, paper or other material. Many devices making it easier to perform this task have been disclosed in the prior art. These include devices with one or more blades which are moved in a circular motion across the top of a sheet of material to cut a circular piece therefrom. However, none of the previously disclosed circular cutters provides a base which securely holds the material to be cut interiorly of the cutting blades during cutting; which does not leave imperfections in the cut circle of material; and which also biases the cutting blades in an unexposed, retracted position when the device is not in use.

For example, U.S. Pat. No. 3,456,346, issued Jul. 22, 1969 to John M. Snyder, discloses a circular cutter for material such as carpets having a disk-shaped member with a pointed axle and a single blade protruding from its bottom surface. The Snyder device is operated by pushing the axle through the material to be cut and twisting the top member 360° to move the blade in a full circle around the axle. This carpet cutter would leave blemishes if used on fabrics, and it does not possess retractable blades.

U.S Pat. No. 1,428,828, issued Jul. 25, 1922 to Maurice A. Butterfield, shows a circular material cutter with a top member which is twisted 180° to move two cutting wheels in a circle across the material to be cut. The circular material cutter of Butterfield differs from the present invention in that the cutting wheels are not in a retracted position when the device is not in use, the material to be cut is not held securely beneath a disk-shaped base, and the device does not have a compact structure to make it safe and easy to store.

U.S. Pat. No. 4,593,467, issued Jun. 10, 1986 to Tibor Safar shows a device for cutting a circular piece from a sheet material having a beam with two blades mounted thereon which is attached to a base member via a spring and shaft assembly that serves to bias the blades to a retracted position when the device is not in use. The device of Safar differs from the present invention in various ways including that the base member holds the waste portion of the sheet material being cut, rather than holding the piece interior to the cut. Also, the device utilizes a vacuum holder to hold in place the circular piece being cut out.

U.S. Pat. No. 3,621,574 issued Nov. 23, 1971 to Gerald F. Yanke and Erica Road, shows a circular material cutter having a disk-shaped base member that holds the piece being cut and a rotating arm with a blade mounted on its radial end which is moved in a circle around the base to cut the piece from a sheet material. The device of Yanke and Road differs from the present invention in that the cutting blade is not biased toward a retracted position when the device is not in use.

U.S. Pat. Nos. 4,173,913 (Nicholson) and 4,426,781 (Kufrin) show devices for cutting circular pieces from a sheet material, each device being operated by moving a blade-carrying member through a complete circle across the material being cut. These devices differ from the present invention in that they must be turned through 360°, making it difficult to complete the cut in a single motion. Also, the devices do not securely hold the piece being cut beneath a disk-shaped base to avoid damaging the piece.

U.S. Pat. Nos. 2,230,400 (Cadirola), 2,066,381 (Albertson) and German document number 2,910,642 (Ihata et al.) show circular material cutters having rotating arms with cutting wheels mounted on the ends thereof which are moved in a circle around the base member to cut a circular piece from a sheet material. The above mentioned devices differ from the present invention in that the cutting wheels are not in a retracted position when the devices are not in use; the material to be cut is not held securely beneath a disk-shaped base; and the devices do not have a compact structure to make them safe and easy to store.

U.S. Pat. Nos. 4,645,390 (Pecha et al.) and 3,934,343 (Witecki) and German Patent No. 119286 (Weibel) are mentioned to show other examples of circular material cutters which differ greatly from the present invention.

None of the above inventions and patents, taken either singularly or in combination, is seen to describe the instant invention as claimed. Thus a circular material cutter solving the aforementioned problems is desired.

SUMMARY OF THE INVENTION

The present invention relates to a device for cutting a circular piece from a sheet of fabric or other material. More specifically, the circular material cutter of the present invention includes the following components for cutting a circular piece of fabric which has been spread over a work surface. A generally disk-shaped base holds the material to be cut against the work surface. A leg support is connected to the base for positioning a plurality of legs radially outward from the base. A vertically oriented, cutting blade is mounted on each of the legs. All of the cutting blades are positioned equidistant from the center of the disk-shaped base. Thus, when the circular material cutter is positioned over the material to be cut and the legs are rotated about the center of the base, the plurality of cutting blades will circumvolve the base to cut a circular piece from the sheet of material. It is preferable if the cutting blade comprises a sharpened edged cutting wheel mounted on the leg for rotation relative thereto. The rotating wheels provide cleaner cuts through material than do straight edge razors.

Accordingly, the disk-shaped base frictionally holds against the work surface that portion of the material which will become the circular piece to be used after cutting, hereinafter called the circular portion. Because the disk-shaped base holds the circular portion by friction, the base leaves no holes, tears, mars, or imperfections in the circular portion. Also, because the disk-shaped base holds the material interior of the cut, the invention can be used on pieces of material which are only marginally larger than the desired circle. This would be impossible if the material cutter held the material exterior of the cut because a substantial circumference of waste material would be required for proper operation.

The material cutter also includes a blade vertical positioning means which enables the cutting blades to be selectively moved between a cutting position and a retracted position. In the cutting position, the cutting blades extend below the base for cutting the material in the manner described above. In the retracted position, the cutting blades are retracted above the bottom surface of the base. Including means for retracting the blades upward into the retracted position minimizes the potential of injury to a user during periods of non-use. Further, a retracted position biasing means is also included for biasing the device in the retracted position. The retracted position biasing means improves safety to the user and also enables safer storage and transport of the circular material cutter. Finally, the circular material cutter possesses a means to enable manual operation. This manual operation means enables the user to move the blades to the cutting position and to rotate the exposed cutting blades around the disk-shaped base for cutting a circle out of the material.

The circular material cutter has two alternative embodiments. The first embodiment is directed towards a fixed-radius circular material cutter. The second embodiment is directed towards an adjustable-radius circular material cutter. The fixed-radius cutter provides a simple, adjustment-free structure. The adjustable-radius embodiment enables the user to cut opposing arcs approximating circles of various radii with a single device.

Specifically, the fixed-radius embodiment of the circular material cutter is composed as follows. A disk-shaped base is adapted to bear against the material being cut. The leg support comprises a disc-shaped plate having a top plate surface, a bottom plate surface, and a circumferential edge surface. The plurality of legs are disposed at predetermined, spaced intervals around the circumference of the disc-shaped plate's edge surface, extending downward therefrom. The cutting blades are disposed for rotation at the distal end of the legs as previously described.

The blade vertical positioning means comprises a shaft interconnecting the disk-shaped base and the disk-shaped plate. The upper end of the shaft is affixed to the bottom surface of the disk-shaped plate, and the lower end of the shaft is received within a radially centered hole formed in the disk-shaped base. The radially centered hole is specifically configured to receive the lower end of the shaft for unlimited horizontal rotation and limited vertical movement of the shaft and the disk-shaped plate relative to the disk-shaped base.

The retracted position biasing means comprises an expansion spring disposed around the shaft. The upper and lower ends of the spring exert pressure on the bottom surface of the disk-shaped plate and the top surface of the disk-shaped base, respectively, thereby biasing the cutting blades in the retracted position. The manual operation means comprises a handle affixed upon the top disk surface. The user manually depresses the handle to overcome the force of the spring and simultaneously move the leg support, the legs and the cutting blades into the cutting position. Once depressed into the cutting position, the user then manually rotates the handle causing the cutting blades to circumvolve the disk-shaped base, cutting a plurality of arcs therearound. Continued rotation of the handle will eventually cause the arc cut by each blade to meet with the arc cut by the adjacent blade, thereby forming a complete circular cut.

It is highly preferable if at least four legs be deployed around the circumference of the disk-shaped plate, equidistantly spaced every 90°. This enables the user to cut a full circle from the material with a singular, comfortable 90° twist of the wrist.

It is also preferable if the circular material cutter is further provided with a spring guard for added protection of the expansion spring. While various shapes may be used, one example includes a open-ended hollow cylinder attached to the bottom surface of the disk-shaped plate, radially outward of the expansion spring. Further, the spring guard may also be sized and configured to limit the downward travel of the disk-shaped plate, serving as a cutting position travel limiter.

The adjustable-radius embodiment of the circular material cutter is composed as follows. A housing is provided which has a bottom housing edge defining a bottom housing opening, a top portion having a plunger opening, and a circumferential portion defining a lever slot therethrough. A housing plate is removably attached to the bottom edge of the housing for covering the bottom housing opening. The housing plate includes a circular portion defining the disk-shaped base. The housing plate further includes a plurality of pairs of concentric semicircular slots disposed circumferentially around the disk-shaped base and extending through the housing plate. Each semicircular slot extends slightly less than 90°. Thus, each pair of slots almost form a circular ring through the housing plate, with the exception of the two opposing radial portions of the housing plate which must be present to support the annular rings dividing the plurality of pairs of slots.

Functionally, when the housing is placed over the material to be cut, the housing plate bears thereagainst to frictionally hold the material. It is highly preferable if the housing plate is removable from the housing so that the cutting blades may be easily accessed for sharpening or replacement, as needed.

The leg support of the adjustable-radius embodiment comprises a plunger and two opposing arms. The plunger is disposed partially within the housing. It has a bottom end positioned above the disk-shaped base and a top end extending through the plunger opening of the top portion of the housing. The two opposing arms radiate from the plunger within the housing. The proximal end of each of the legs is slidably connected to one of the opposing arms for radial adjustment relative to the plunger. The legs are connected such that the cutting blades depending therefrom are positionable radially equidistant relative to the plunger and may be selectively positioned above the respective semicircular slots of any one pair of the concentric semicircular slots.

The blade vertical positioning means comprises the two opposing arms being vertically positioned along the plunger at a height which permits the limited vertical movement of the plunger. The plunger is sized such that when depressed into the cutting position, the bottom edge of the cutting blades are extended through the respective slots of one of the concentric pairs, and the bottom end of the plunger is in frictional contact with the disk-shaped base for causing the same to bear against the material to be cut.

The retracted position biasing means for biasing the cutting blades in the retracted position comprises a spring disposed around the plunger. The spring is interconnected between the interior surface of the top portion of the housing and the leg support. The manual operation means comprises a lever connected to one of the opposing arms. Opposite the connected end, the lever has a gripping end which extends exteriorly from the lever slot of the housing. The lever slot has a vertical positioning section through which the user may move the lever in order to manually move the cutting blades between the retracted position and the cutting position. The lever slot also has a circumferential operation section which is in communication with and extending circumferentially from the bottom of the vertical positioning section. Thus, after the lever is depressed the length of the vertical positioning section of the lever slot, the cutting blades will be in the cutting position.

The user may then manually rotate the lever the length of the circumferential operation section in order to rotate the exposed cutting blades within the pair of concentric semicircular slots around the disk-shaped base for cutting a pair of opposing arcs in the material. As previously discussed, the presence of the two opposing radial portions on the housing plate prevents the cutting blades from cutting a complete circle. However, the two arcs cut by the cutting blades approaches a full circle. Thus, after the circular cutter is used to cut the two arcs, the user may easily use a standard pair of scissors to finish cutting the complete circle. Alternatively, the user may use the circular cutter to cut the initial arcs, next rotate the cutter in place, and subsequently operate the material cutter a second time to produce an entire circle.

Very preferably, the radial positioning of the cutting blades is adjusted with a gear shaft and gears. Specifically, the gear shaft is disposed within the housing, parallel to and substantially coextensive with the two opposing arms. The gear shaft has two oppositely-oriented threaded sections. The proximal end of each of the legs is coupled to one of the oppositely-oriented threaded sections for opposing radial sliding relative to the opposing arms in response to rotation of the gear shaft. In other words, rotation of the gear shaft will move the two legs either towards or away from each other, depending on the shaft's direction of rotation.

A slave gear is attached to the gear shaft for translating rotation thereto. Also, a manually operable master gear extends through the housing and is connected thereto for rotation relative thereto. The master gear is sized for translating rotation to the slave gear only when the leg support is in the retracted position. Thus, the radial position of the cutting blades can only be adjusted when fully retracted and cannot be altered while in use. It is also highly preferable if measurement indicia are incorporated onto the master gear for indicating the radial position of the cutting blades.

It is preferable that the adjustable-radius embodiment of the material cutter be further provided with a plunger cap disposed over the top end of the plunger. The plunger cap is disposed to enable rotation of the depressed plunger relative to the plunger cap. Inclusion of the plunger cap enables the user to firmly press down on the plunger cap and operate the cutter without having the rotating plunger pull the skin of the user's hand.

It is also preferable if the circular material cutter includes a safety mechanism to prevent the cutting blades from being unintentionally moved to the cutting position during periods of non-use. Specifically, a preferred embodiment of the safety mechanism includes an enlarged handle disposed on the gripping end of the lever. The housing further defines a safety slot which is narrower than the enlarged handle to prevent passage of the same therethrough. The safety slot is in communication with and extending from the lever slot to the top portion of the housing.

The connection end of the lever is pivotally connected to the arm of the leg support for enabling vertical pivotal rotation of the lever between a horizontal position and a vertical position. In the horizontal position, the lever is disposed passing through the lever slot. In the vertical position, the lever is disposed, passing through the safety slot. The lever is sized of a length which is sufficiently short to prevent the plunger from vertical downward movement into the cutting position while the lever is vertically positioned through the safety slot. This is because the enlarged handle is too large to pass through the safety slot.

Finally, it is preferable if the adjustable-radius embodiment of the circular material cutter possesses visual diameter indicators disposed upon the top portion of the housing. The visual diameter indicators enable the user to better estimate where the cutting blades will cut the material.

Accordingly, it is a principal object of the invention to provide a circular material cutter which has a plurality of cutting wheels mounted for rotation to cut a circular piece from a sheet material such as fabric or paper.

It is another object of the invention to provide a circular material cutter with cutting wheels that are biased in a retracted position when the device is not in use for added safety.

It is a further object of the invention to provide a circular material cutter which has a compact structure that makes it safe to handle and easy to store.

Still another object of the invention is to provide a circular material cutter having a disk-shaped base that securely holds the material being cut interior to the cutting blade's cut without leaving cuts, holes, tears, or mars therein.

It is still a further object of the invention to provide a fixed-radius embodiment of the cutter having maximum simplicity of structure and ease of use.

It is still a further object of the invention to provide an adjustable-radius embodiment of the cutter which enables a user to cut circles of various diameters.

It is an object of the invention to provide improved elements and arrangements thereof in a circular material cutter for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
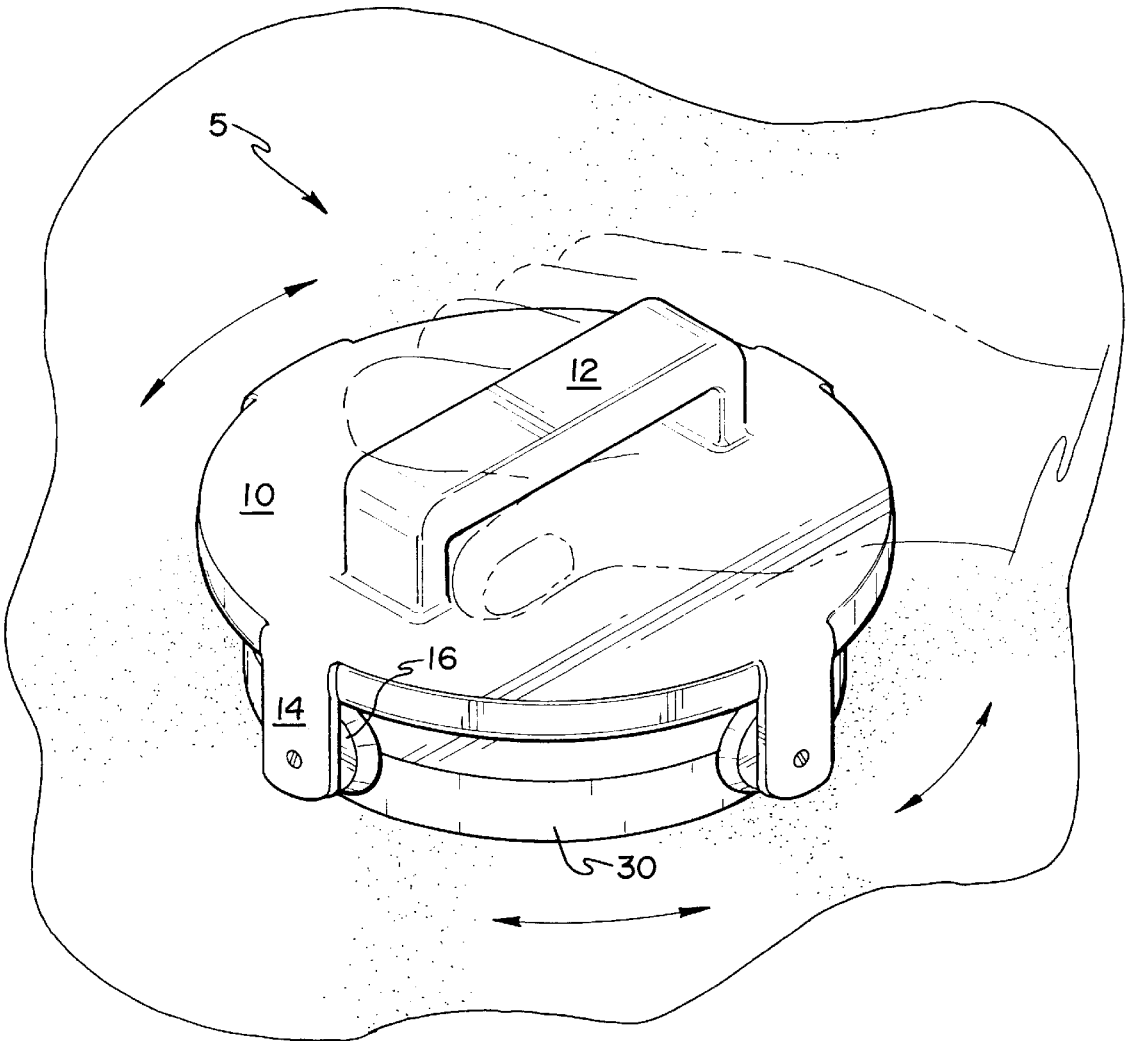
FIG. 1 is an environmental perspective view of the fixed-radius embodiment of the circular material cutter of the present invention disposed over a material to be cut.
Figure 2:
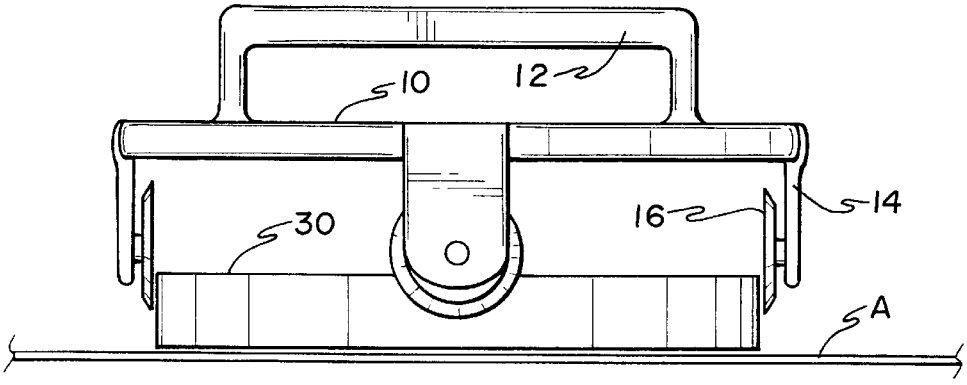
FIG. 2 is an environmental side view of the fixed-radius embodiment of the present invention, disposed in the retracted position.
Figure 3:
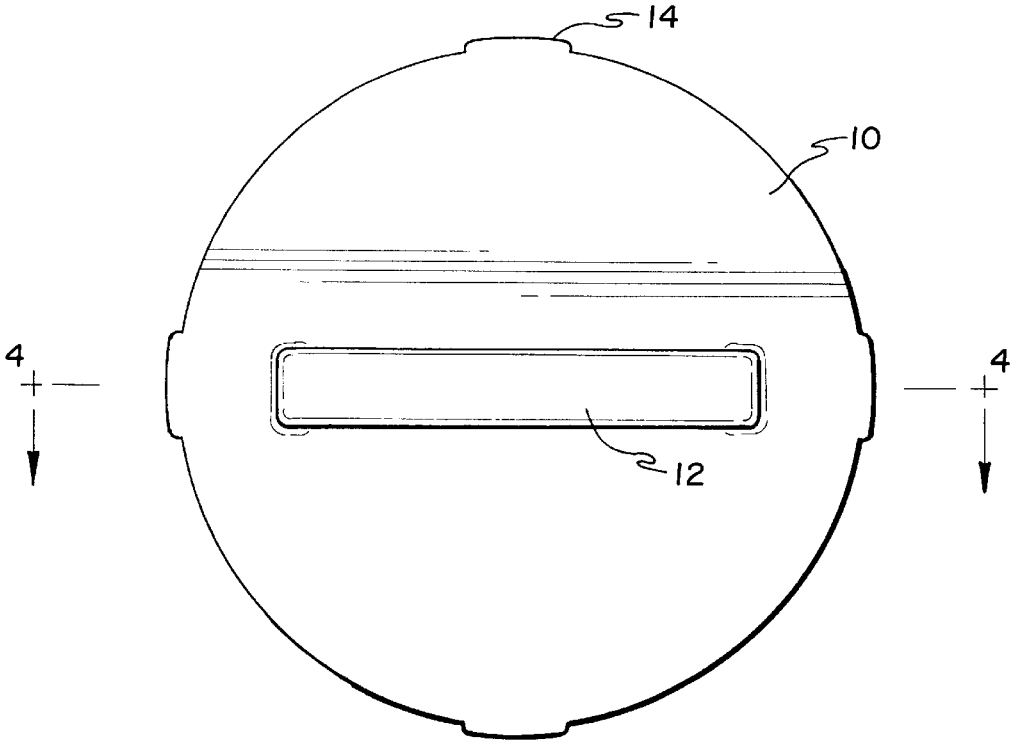
FIG. 3 is a top view of the fixed-radius embodiment of the present invention.

Referring to the drawings, FIG. 1 through FIG. 5 depict various views of the fixed-radius embodiment of the circular material cutter 5 according to the present invention. More specifically, FIG. 1 through FIG. 3 depict perspective, side, and top views, respectively. These three figures depict the disk-shaped base 30 bearing against the material A which is to be cut. The leg support comprises a disk-shaped plate 10 disposed above the disk-shaped base 30 for unlimited horizontal rotation (as depicted by the unnumbered arrows) and limited vertical movement of the disk-shaped plate 10 relative to the disk-shaped base 30. Four legs 14 are disposed at evenly spaced intervals around the circumference of the edge surface of the disk-shaped plate 10, extending downward therefrom. A vertically-oriented sharpened-edged cutting wheel 16 is mounted on the distal end of each of the legs 14 for rotation relative thereto. The manual operation means comprises a handle 12 which is integrally attached to the top surface of the disk-shaped plate 10.

Figure 4:
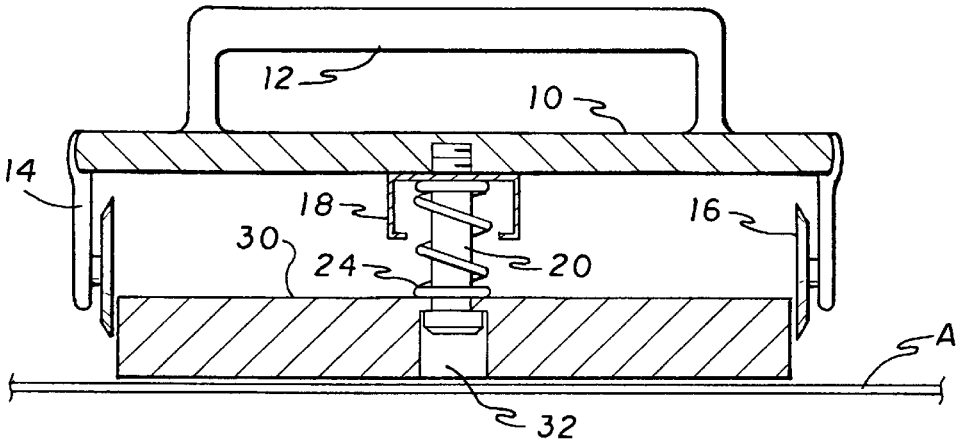
FIG. 4 is an environmental cross-sectional side view along lines 4—4 of FIG. 3, depicting the circular material cutter in the retracted position.
Figure 5:
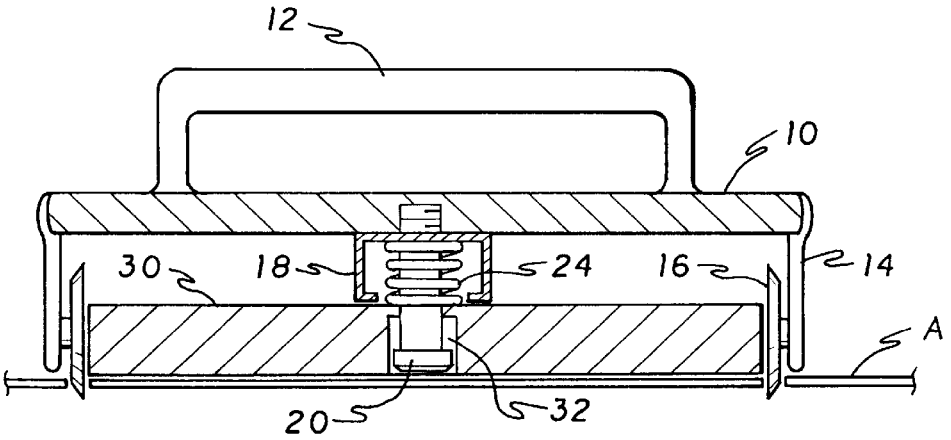
FIG. 5 is an environmental cross-sectional side view along lines 4—4 of FIG. 3, depicting the circular material cutter in the cutting position.

FIG. 4 and FIG. 5 are environmental cross-sectional side views along lines 4—4 of FIG. 3. FIG. 4 depicts the invention in the retracted position, wherein the cutting wheels 16 are retracted above the bottom surface of the disk-shaped base 30. FIG. 5 depicts the invention in the cutting position, wherein the lower edge of the cutting wheels 16 extend below the disk-shaped base 10. These two figures also clearly depict the additional parts of the circular material cutter 5, not shown in FIGS. 1–3. Specifically, additionally depicted is the blade vertical positioning means for moving the cutting wheels 16 between the cutting position and the retracted position. The blade vertical positioning means comprises a shaft 20, having an upper end affixed to the bottom surface of the disk-shaped plate 30. Also, the disk-shaped base 30 defines a radially centered hole 32 configured to receive the lower end of the shaft 20. This interconnection of the shaft 20 between the disk-shaped base 30 and the disk-shaped plate 10 allows for unlimited horizontal rotation and limited vertical movement of the shaft 20 and the disk-shaped plate 10 relative to the disk-shaped base 30. A retracted position biasing means, comprising expansion spring 24 disposed around the shaft 20 between the bottom surface of the disk-shaped plate 10 and the top surface of the disk-shaped base 30, biases the cutting wheels 16 in the retracted position. When the cutting wheels 16 are in this position, there is little danger of accidentally cutting one's self or the sheet material A.

A spring guard 18 is attached to the bottom surface of the disk-shaped plate 10, radially outward of the expansion spring 20 for protection thereof. The spring guard 18 is also sized and configured to limit the downward travel of the disk-shaped plate 10 and bear against the top surface of disk-shaped base 30 when the material cutter 5 is in the cutting position to cause the disk-shaped base 30 to bear against the sheet material A upon which it is placed, thereby holding the circular piece being cut firmly in place.

To operate the fixed-radius circular material cutter 5, the user depresses the handle 12, thereby pressing the disk-shaped plate 10 downward into the cutting position and causing the cutting wheels 16 to penetrate the material A. Once depressed, the user simply rotates the handle to cause the four cutting wheels 16 to cut four arcs around the disk-shaped base 30. The force of the spring 24 against the disk-shaped base 30 causes the disk-shaped base 30 to bear against the material A for frictionally holding the material to be cut. Twisting of the user's hand 90° will cause the four arcs to intersect, creating a full circle cut from the material.

Figure 6:
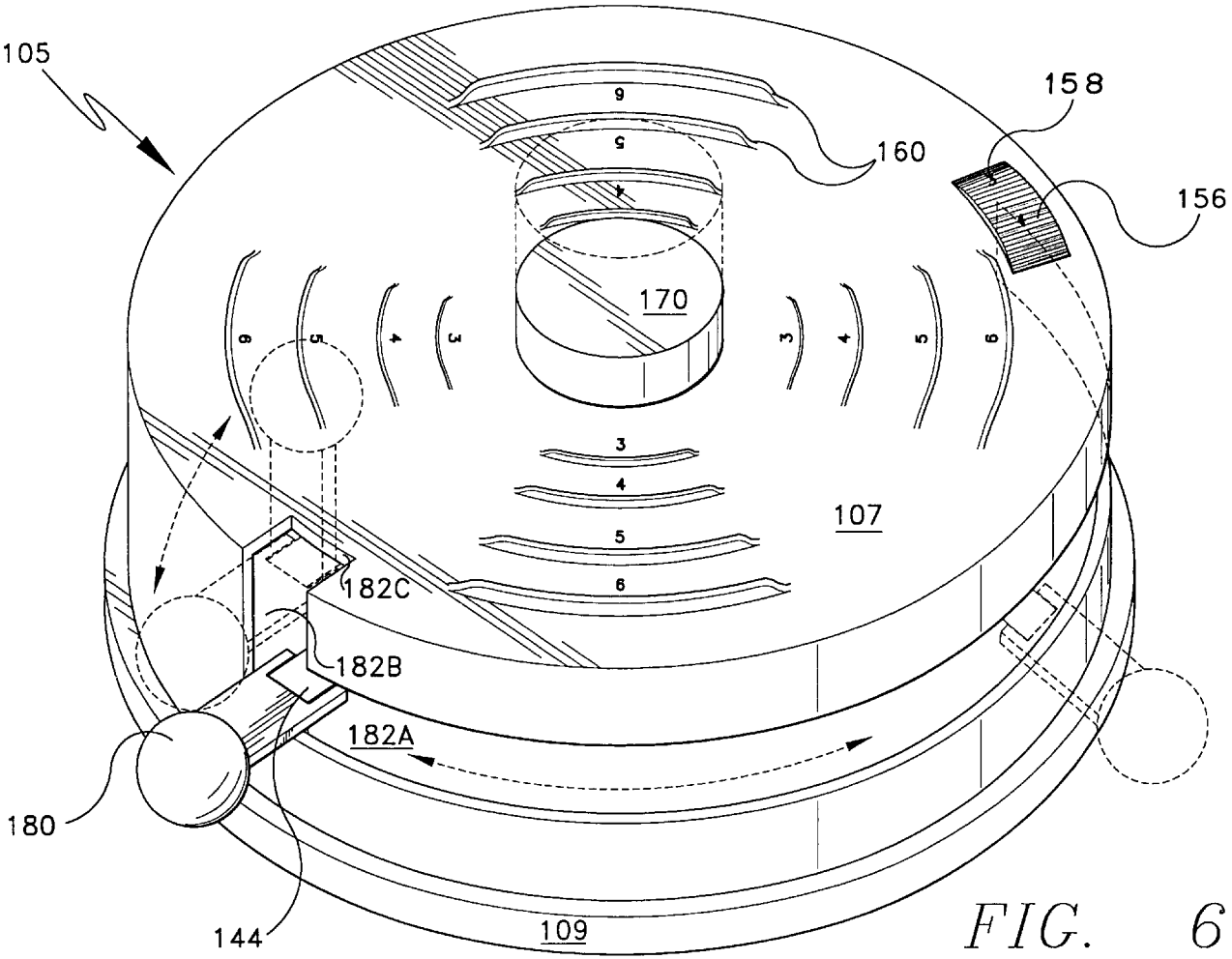
FIG. 6 is a perspective view of the adjustable-radius embodiment of the circular cutter of the present invention.
Figure 7:
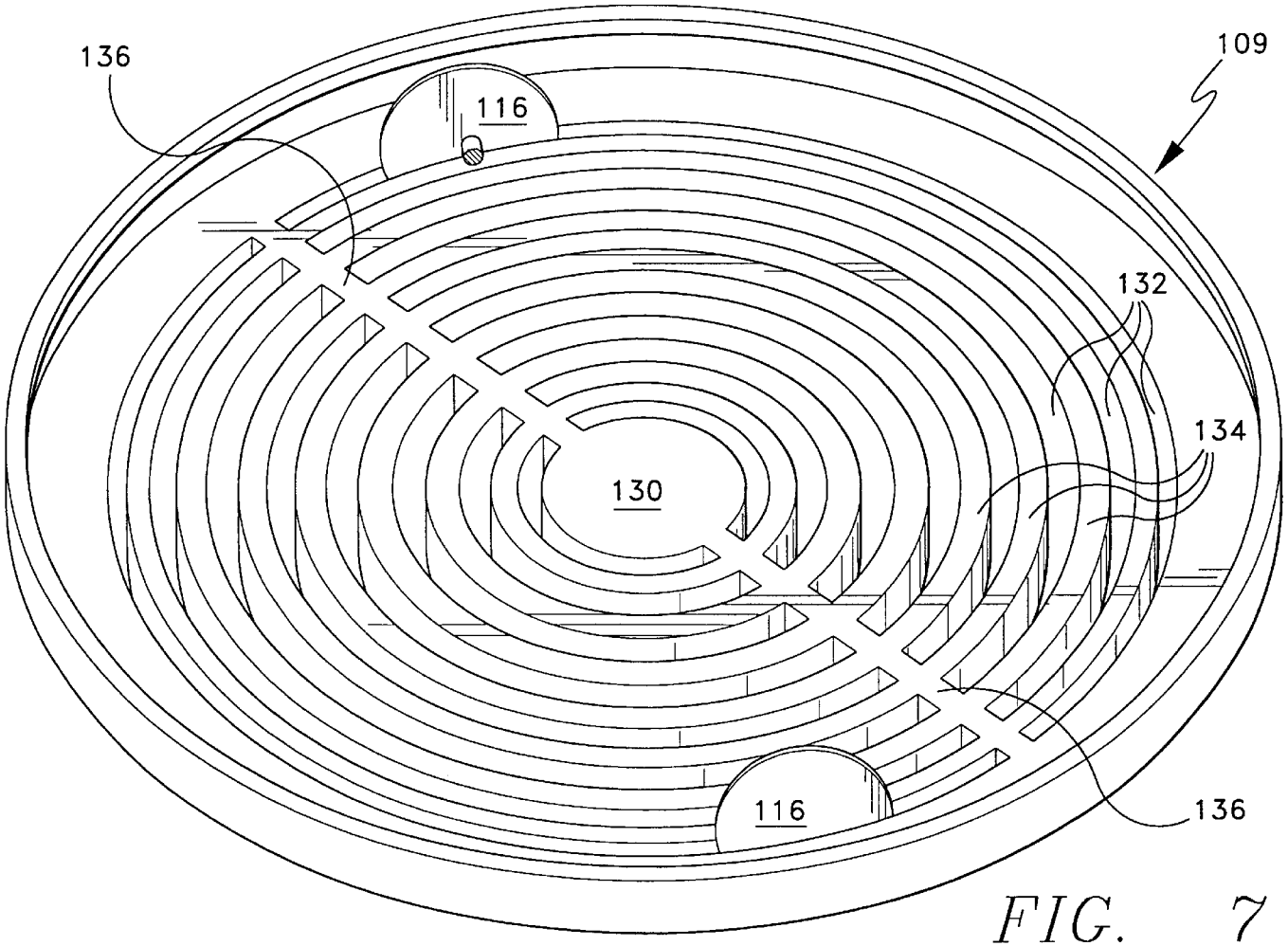
FIG. 7 is a top perspective cutaway view of the cutting blades disposed within one pair of the concentric semicircular slots of the housing plate.

FIG. 6 through FIG. 10 depict various views of the adjustable-radius embodiment of the circular material cutter 105 according to the present invention. More specifically, FIG. 6 is a perspective view of the adjustable-radius embodiment of the circular cutter 105. A hollow housing 107 internally contains various components of the invention such as the leg support, the legs, and the cutting wheels (not shown in FIG. 6). A housing plate 109 is removably attached to the bottom surface edge of the housing 107. Functionally, when the housing 107 is placed over the material to be cut, the housing plate 109 bears thereagainst to frictionally hold the material. The housing plate 109 is removable from the housing 107 so that the cutting wheels (as shown in FIG. 7) may be easily accessed for sharpening or replacement, as needed.

A plunger cap 170 covering a plunger 140 (shown in FIG. 9) extends through an opening in the top surface of the housing 107. The plunger cap 170 is depicted positioned in the cutting position in solid line and further depicted in the retracted position in phantom line. Also, a lever 112 extends out of the housing 107 through a lever slot 182. The lever 112 has an enlarged handle 180 at the end thereof for gripping and manipulation of the lever 112. The lever slot 182 has a circumferential operation section 182*a* extending partially around the circumference of the housing 107. The lever slot 182 has a vertical positioning section 182*b* extending upward from the circumferential operation section 182*a*.

The material cutter 105 has an internal spring 120 (shown in FIG. 9) which biases the plunger 140 and the lever 112 upward, in the retracted position. Manual depression of the plunger cap 170 downward moves the cutting wheels 116 into the cutting position and aligns the lever 112 (depicted in solid line) with the circumferential operation section 182*a* of the lever slot 182. Once so positioned, the lever 112 may be manually rotated along the circumferential operation section 182*a* to cause the exposed blades to cut arcs approximating a circle in a material.

FIG. 6 also depicts a safety mechanism to prevent the cutting wheels from being unintentionally moved to the cutting position during periods of non-use. Specifically, the housing 107 further defines a safety slot 182*c* which is narrower than the enlarged handle 180 to prevent passage of the same therethrough. The safety slot 182*c* is in communication with the lever slot 182, extending to the top portion of the housing 107. The connection end of the lever 112 is pivotally connected to one of the opposing arms 144 of the internal leg support for upward pivotal rotation of the lever 112 from a horizontal position in which the lever 112 passes through the vertical positioning section 182*b*, to a vertical position in which the lever 112 passes through the safety slot 182*c*. The lever 112 is sized to prevent the plunger from vertical downward movement into the cutting position while the lever is vertically positioned through the safety slot 182*c*.

FIG. 6 also depicts the master gear 156 extending through the top surface of the housing 107 for manual manipulation. The master gear 156, if rotated while the circular cutter 105 is in the retracted position, will adjust the radial position of the cutting wheels. Adjustment of the master gear 156 enables the user to cut circles of varying diameter. Measurement indicia 158 are incorporated onto the master gear 156 for indicating the radial position of the cutting wheels. Visual diameter indicators 160 are disposed upon the top portion of the housing 107 to enable the user to better estimate where the cutting wheels will cut the material.

FIG. 7 is a top perspective view of the housing plate 109 and the cutting wheels 116 disposed therethrough. The housing plate 109 includes a circular portion defining the disk-shaped base 130. A plurality of pairs of concentric semicircular slots 132 extend through the housing plate 109, circumferentially around the disk-shaped base 130. Each semicircular slot 132 extends slightly less than 90°. Thus, each pair of semicircular slots 132 almost forms a circular ring through the housing plate 109, with the exception of the two opposing radial portions 136 of the housing plate 109, which support the annular rings 134 dividing the plurality of pairs of slots 132. The two cutting wheels 116 are depicted, cutaway away from the legs (not shown for clarity of illustration) to which the cutting wheels 116 are rotatably mounted. The cutting wheels 116 are disposed in the cutting position, extending through one pair of the concentric semicircular slots 132 of the housing plate 109. Rotation of the lever along the circumferential operation section of the housing rotates the cutting wheels 116 within the chosen pair of semicircular slots 132.

Figure 8:
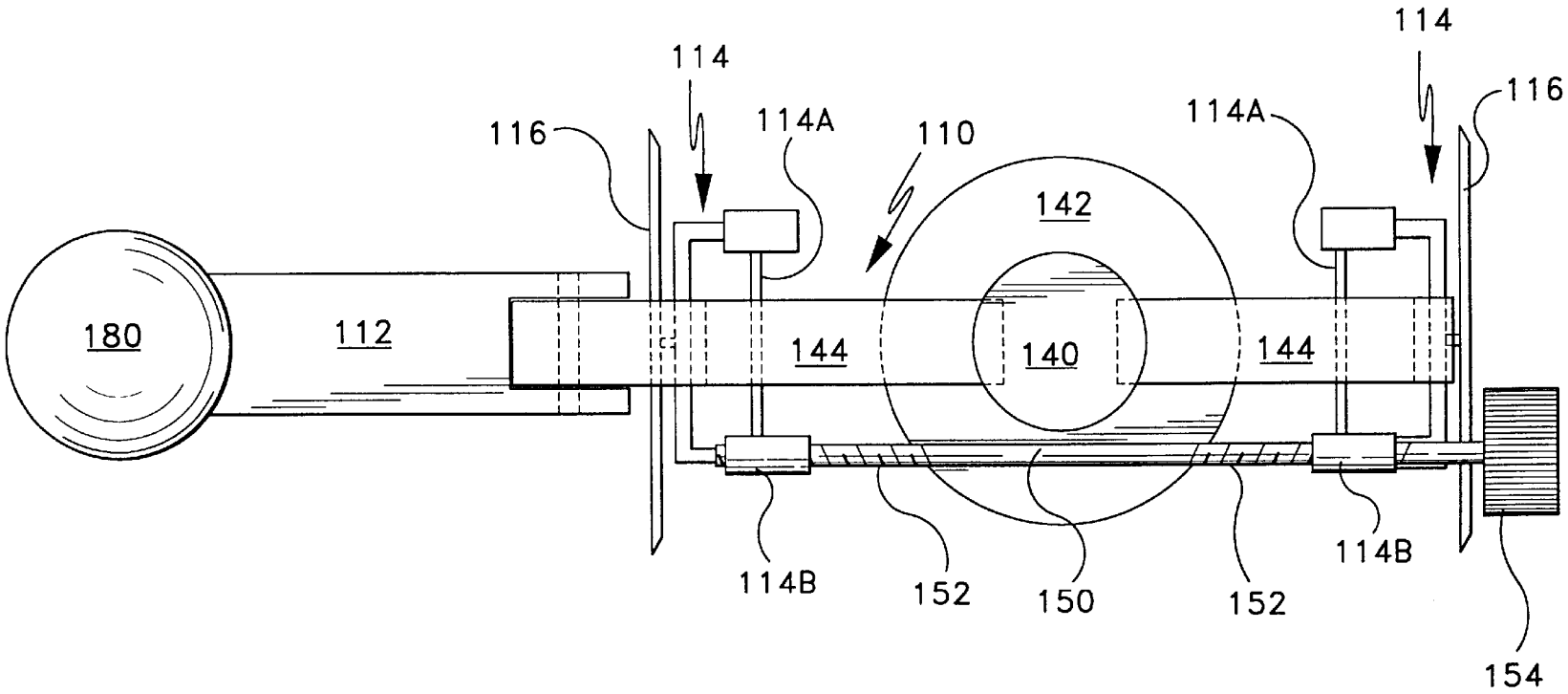
FIG. 8 is a top view of the internal components of the adjustable-radius embodiment of the circular material cutter.

FIG. 8 is a top view of the internal components of the adjustable-radius embodiment of the circular material cutter 105. The leg support 110 includes the plunger 140 and the two opposing arms 144 radiating from the plunger 140. The plunger 140 has a bottom end 142 sized for positioning above the disk-shaped base of the housing plate (not shown). The proximal end of each of the two legs 114 possesses a leg axle 114*a* which passes through the slotted portion (depicted in phantom line) of one of the opposing arms 144. The distal end of each of the two legs 114 possesses a sharpened edged cutting wheel 116 which is mounted for rotation relative thereto. The leg axles 114*a* travel radially within the slotted portion of the opposing arms 144 for equidistant, adjustable, radial positioning of the sharpened edged cutting wheel 116 relative to the plunger 140 for selective positioning of the cutting wheels 116 above the respective slots of any one pair if the concentric semicircular slots (not shown). A gear shaft 150 is disposed parallel to and substantially coextensive with the two opposing arms 144. The gear shaft 150 has two oppositely-oriented threaded sections 152. The proximal end of each of the two legs 114 possesses a coupling 114*b* which is coupled to one of the oppositely-oriented threaded sections 152 of the shaft 150.

A slave gear 154 is attached to the gear shaft 150 for translating rotation thereto. Rotation of the gear shaft 150 causes opposing radial movement of the couplings 114*b*. This, in turn, causes opposing radial travel of the two leg axles 114*a* within the slots of the opposing arms 144.

Lever 112 is pivotally connected by pivoting means well known in the art (depicted in phantom line) to one of the opposing arms 144 for upward rotation relative thereto. Also depicted, lever 112 has an enlarged handle 180 disposed on the gripping end thereof.

Figure 9:
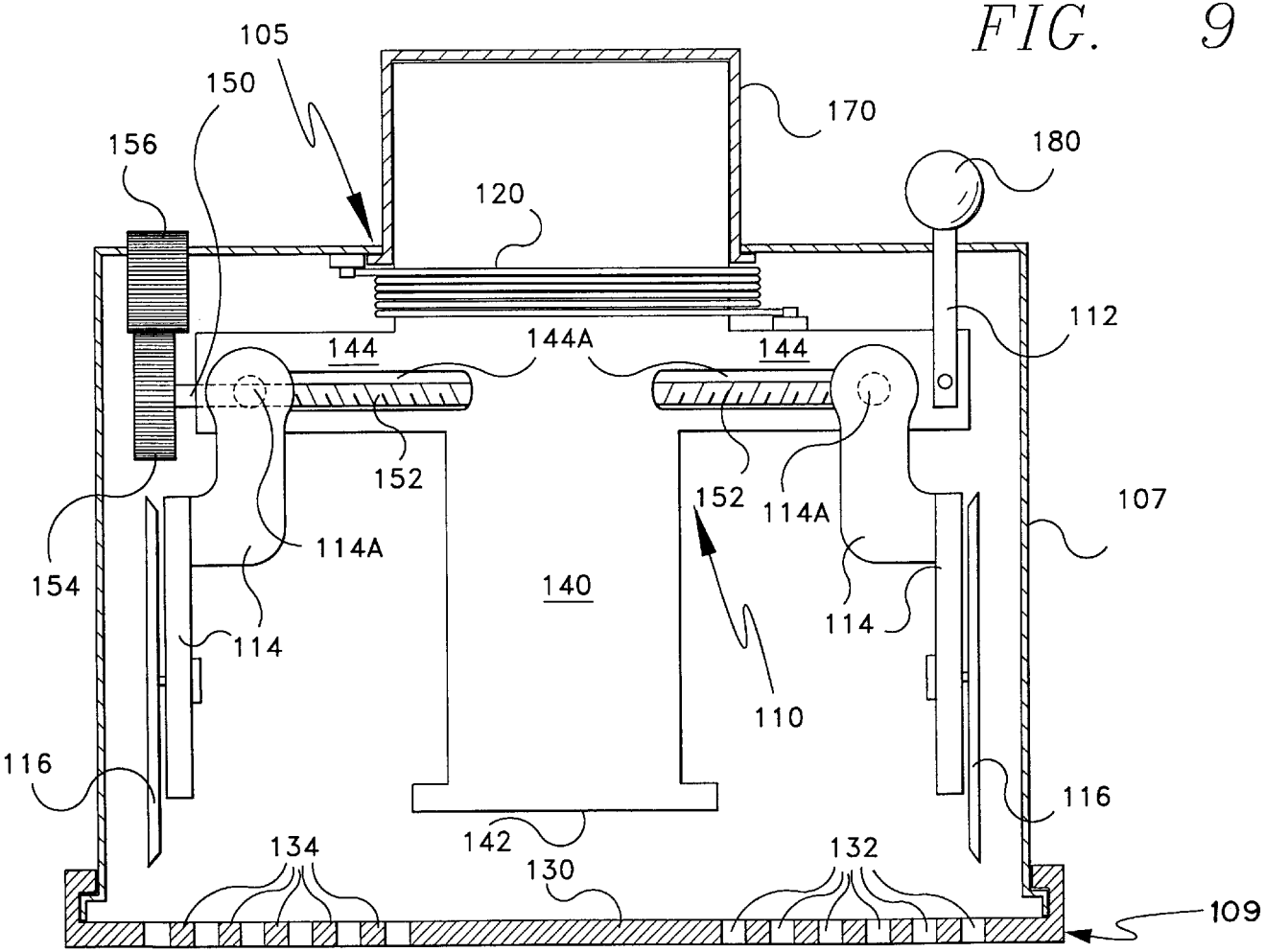
FIG. 9 is a side cutaway view of the adjustable-radius embodiment, depicting the cutting blades in the retracted position.
Figure 10:
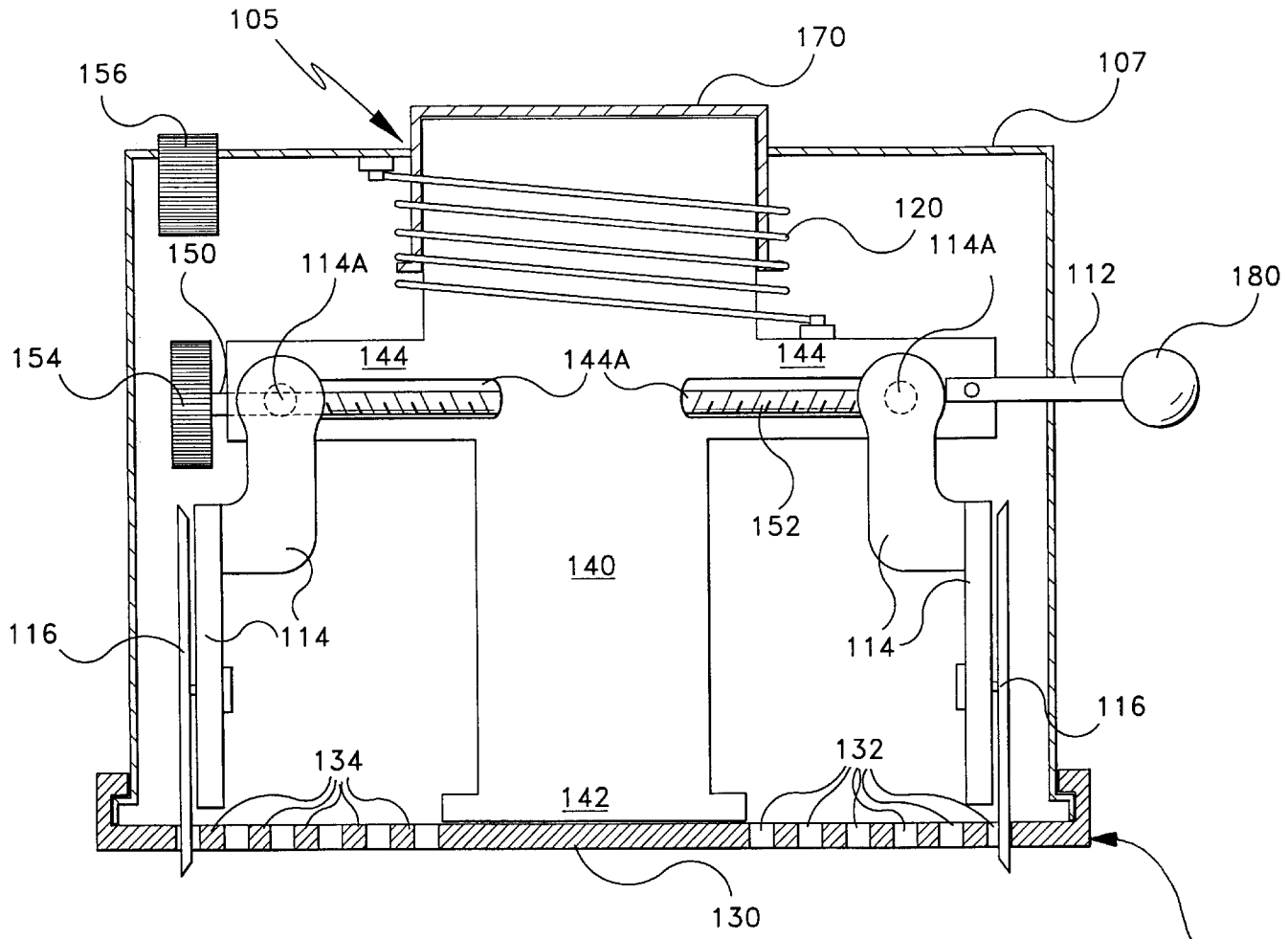
FIG. 10 is a side cutaway view of the adjustable-radius embodiment, depicting the cutting blades in the cutting position.

FIG. 9 and FIG. 10 are side cutaway views of the adjustable-radius embodiment, depicting the sharpened edged cutting wheels 116 in the retracted position and the cutting position, respectively. Both figures depict leg support 110 which includes plunger 140 and two opposing arms 144 radiating from the plunger 140. The plunger 140 has a bottom end 142 sized for positioning above the disk-shaped base 130 of the housing plate 109. The plunger 140 also has a top end extending through an opening in the top portion of housing 107. A plunger cap 170, is disposed over the top end of the plunger 140 and limited in upward movement by the housing 107. The plunger cap 170 enables rotation of the plunger 140 relative thereto while the plunger cap 170 is being manually depressed. A spring 120, interconnected between the interior surface of the housing 107 and one of the opposing arms 144, biases the leg support 110 in the retracted position, as depicted in FIG. 9.

The proximal end of each of the two legs 114 possesses a leg axle 114*a* which passes through the slotted portion 144*a* of one of the opposing arms 144. The distal end of each of the two legs 114 possesses a sharpened edged cutting wheel 116 which is mounted for rotation relative thereto. The leg axles 114*a* travel radially within the slotted portions 144*a* of the opposing arms 144 for equidistant, adjustable, radial positioning of the sharpened edged cutting wheel 116 relative to the plunger 140 for selective positioning of the cutting wheels 116 above the respective slots of any one pair of the concentric semicircular slots 132 of the housing plate 109.

Gear shaft 150 is disposed behind the two opposing arms 140, extending parallel and substantially coextensive therewith. The gear shaft 150 has two oppositely-oriented threaded sections 152. The proximal end of each of the two legs 114 possesses a coupling (not shown) which is coupled to one of the oppositely-oriented threaded sections 152 of the shaft 150. Slave gear 154 is attached to the gear shaft 150 for translating rotation thereto. Rotation of the gear shaft 150 causes opposing radial movement of the couplings. This, in turn, causes opposing radial travel of the two leg axles 114*a* within the slotted portions 144*a* of the opposing arms 144.

Master gear 156 is connected to the housing 107, partially extending exterior thereto to allow manually operation thereof. Master gear 156 is sized to translate rotation to slave gear 154 only when the leg support 110 is in the retracted position. Thus, during operation, shaft 150 cannot turn to radially move the cutting wheels 116.

Lever 112 is pivotally connected to one of the opposing arms 144 for upward rotation relative thereto. Also depicted, lever 112 has an enlarged handle 180 disposed on the gripping end thereof. FIG. 9 depicts lever 112 in the safety position, passing through the safety slot (not shown) in the top portion of housing 107. The enlarged handle 180 is sized sufficiently large to prevent passage thereof through the safety slot, thereby preventing the plunger 140 from being depressed into the cutting position. FIG. 10 depicts lever 112 in the operating position, passing through the circumferential operation section of the lever slot (not shown) of the circumferential portion of the housing 107. The positioning of the lever 112 enables manual depression of the plunger 140. The force of the depression overcomes the bias of spring 120, moving the material cutter 105 into the cutting position. In the cutting position, the lower edges of the cutting wheels 116 are extended through one pair of the semicircular slots 132 of the housing plate 109, and the bottom end 142 of the plunger 140 bears against the disk-shaped base 130 causing the same to frictionally hold a material to be cut against the work surface.

It is to be understood that the present invention is not limited to the embodiment described above, but encompasses any and all embodiments within the scope of the following claims.

I claim:

1. A circular material cutter for cutting a circular piece from a material which has been spread over a work surface, comprising:

a disk-shaped base having a top base surface and having a bottom base surface adapted to bear against the material being cut for frictionally holding the material to be cut against the work surface, the disk-shaped base having a radial center;

a leg support disposed above the disk-shaped base for horizontal rotation of the leg support relative to the material and for limited vertical movement relative to the base, said leg support comprises a disc-shaped plate having a top plate surface, a bottom plate surface, and an edge surface;

a plurality of legs extending downward from the leg support, each of the legs having a proximal end connected to the leg support and a distal end opposite and below the proximal end, said plurality of legs extend downward from the edge surface of the disc-shaped plate, the legs being disposed at predetermined, spaced intervals around the circumference of the edge surface;

a plurality of vertically oriented cutting blades, each of the cutting blades mounted on the distal end of each of the legs, all of the cutting blades positioned radially outward of the disk-shaped base, equidistant from the center thereof;

blade vertical positioning means for selectively moving the cutting blades between a cutting position wherein the cutting blades extend below the base and a retracted position wherein the cutting blades are retracted above the bottom surface of the base, said blade vertical positioning means comprises a shaft having an upper end affixed to the bottom surface of the disk-shaped plate, a lower end, and the disk-shaped base defining a radially centered hole configured to receive the lower end of the shaft for horizontal rotation and limited vertical movement of the shaft and the disk-shaped plate relative to the base;

retracted position biasing means for biasing the cutting blades in the retracted position, said retracted position biasing means for biasing the cutting blades in the retracted position comprises an expansion spring disposed around the shaft between the bottom surface of the disk-shaped plate and the top surface of the disk-shaped base; and manual operation means for moving the blades to the cutting position and rotating the exposed cutting blades around the disk-shaped base for cutting a circle out of the material, said manual operation means comprises a handle affixed upon the top disk surface for enabling manual depression and rotation of the disk-shaped plate.

2. The circular material cutter disclosed in claim 1, wherein the vertically oriented cutting blade comprises a sharpened edged cutting wheel mounted on the distal end of the leg for rotation relative thereto.

3. The circular material cutter disclosed in claim 1, wherein the handle is integral with the disk-shaped plate.

4. The circular material cutter disclosed in claim 1, wherein at least four legs extend downward from the edge surface of the disk-shaped plate, the legs being disposed at evenly spaced intervals around the circumference of the edge surface plate, whereby when the disk-shaped plate is pressed downward into the cutting position, a full circle may be cut from the material by a single 90° twist of the hand.

5. The circular material cutter as defined in claim 1, further comprising a spring guard attached to the bottom surface of the disk-shaped plate, radially outward of the expansion spring for protection thereof.

6. The circular material cutter as defined in claim 5, wherein the spring guard is sized and configured to bear against the top surface of disk-shaped base when the leg support is in the cutting position for limiting the downward travel of the disk-shaped plate and for causing the disk-shaped base to bear against the material upon which it is placed, thereby holding the circular piece being cut firmly in place.

7. A circular material cutter for cutting a circular piece from a material which has been spread over a work surface, comprising:

a disk-shaped base having a top base surface and having a bottom base surface adapted to bear against the material being cut for frictionally holding the material to be cut against the work surface, the disk-shaped base having a radial center;

a leg support disposed above the disk-shaped base for horizontal rotation of the leg support relative to the material and for limited vertical movement relative to the base;

a plurality of legs extending downward from the leg support, each of the legs having a proximal end connected to the leg support and a distal end opposite and below the proximal end;

a plurality of vertically oriented cutting blades, each of the cutting blades mounted on the distal end of each of the legs, all of the cutting blades positioned radially outward of the disk-shaped base, equidistant from the center thereof;

blade vertical positioning means for selectively moving the cutting blades between a cutting position wherein the cutting blades extend below the base and a retracted position wherein the cutting blades are retracted above the bottom surface of the base:

retracted position biasing means for biasing the cutting blades in the retracted position:

manual operation means for moving the blades to the cutting position and rotating the exposed cutting blades around the disk-shaped base for cutting a circle out of the material;

a housing having a bottom housing edge defining a bottom housing opening, a top portion having a plunger opening, and a circumferential portion defining a lever slot therethrough, the lever slot having a circumferential operation section and a vertical positioning section in communication with and extending upward from the circumferential operation section;

a housing plate removably attached to the bottom housing edge and covering the bottom housing opening, the housing plate including a circular portion defining the disk-shaped base, and including a plurality of pairs of concentric semicircular slots extending through the housing plate and disposed circumferentially around the disk-shaped base; and wherein:

said leg support comprises a plunger disposed partially within the housing, the plunger having a bottom end positioned above the disk-shaped base, a top end extending through the plunger opening of the top portion of the housing, and two opposing arms radiating from the plunger within the housing;

said proximal end of each of the legs is slidably connected to one of the opposing arms for equidistant, adjustable, radial positioning of the legs relative to the plunger for selectively positioning the cutting blades above the respective semicircular slots of any one pair of the concentric semicircular slots;

said blade vertical positioning means comprises the two opposing arms being vertically positioned along the plunger at a height for permitting limited vertical movement of the plunger, the plunger being sized such that when depressed, the cutting blades are in the cutting position, and the bottom end of the plunger is in frictional contact with the disk-shaped base for causing the same to bear against the material to be cut;

said retracted position biasing means for biasing the cutting blades in the retracted position comprises a spring disposed around the plunger, the spring interconnected between the interior surface of the top portion of the housing and the leg support; and said manual operation means comprises the plunger being sized for manual depression from the retracted position into the cutting position; and a lever having a connection end attached to one of the opposing arms and having a gripping end extending exteriorly from the lever slot of the housing for enabling manual operation of the leg support for rotation of the exposed cutting blades around the disk-shaped base for cutting a pair of opposing arcs approximating a circle out of the material.

8. The circular material cutter disclosed in claim 7, further comprising a plunger cap disposed over the top end of the plunger for enabling rotation of the plunger relative to the plunger cap while the plunger cap is being manually depressed.

9. The circular material cutter disclosed in claim 7, further comprising a safety mechanism for preventing the cutting blades from being unintentionally moved to the cutting position during periods of non-use.

10. The circular material cutter disclosed in claim 9, the safety mechanism comprising:

an enlarged handle disposed on the gripping end of the lever;

the housing further defining a safety slot narrower than the enlarged handle to prevent passage of the same therethrough, the safety slot in communication with and extending from the lever slot to the top portion of the housing;

the connection end of the lever being pivotally connected to the opposing arm for upward pivotal rotation of the lever from a horizontal position for passage through the lever slot to a vertical position for passage through the safety slot; and the lever being sized to prevent the plunger from vertical downward movement into the cutting position while the lever is vertically positioned through the safety slot.

11. The circular material cutter disclosed in claim 7, further comprising:

a gear shaft disposed parallel to and substantially coextensive with the two opposing arms, the gear shaft having two oppositely-oriented threaded sections, the proximal end of each leg coupled to one of the oppositely-oriented threaded sections for opposing radial travel thereof relative to the opposing arms in response to rotation of the gear shaft;

a slave gear attached to the gear shaft for translating rotation thereto; and a manually operable master gear passing through the housing and connected thereto for rotation relative thereto, the master gear sized for translating rotation to the slave gear only when the leg support is in the retracted position.

12. The circular material cutter disclosed in claim 11, further comprising measurement indicia incorporated onto the master gear for indicating the radial position of the cutting blades.

13. The circular material cutter disclosed in claim 7, further comprising visual diameter indicators disposed upon the top portion of the housing.

* * * * *